US006998961B2

(12) United States Patent
Stihler

(10) Patent No.: US 6,998,961 B2
(45) Date of Patent: Feb. 14, 2006

(54) ALARM CLOCK WITH VOICE MESSAGE INPUT

(76) Inventor: Shirley Ann Stihler, 430 Pleasant Ridge Rd., Del Rey Oaks, CA (US) 93940

( * ) Notice: Subject to any disclaimer, the term of this patent is extended or adjusted under 35 U.S.C. 154(b) by 156 days.

(21) Appl. No.: 10/766,609

(22) Filed: Jan. 28, 2004

(65) Prior Publication Data

US 2005/0162980 A1 Jul. 28, 2005

(51) Int. Cl.
*G08B 1/00* (2006.01)

(52) U.S. Cl. ..... 340/309.9; 340/309.7; 340/309.8; 340/309.16; 340/331; 340/327; 368/10; 368/12; 368/13

(58) Field of Classification Search ..... 340/309.1, 340/309.7, 309.8, 309.9, 309.16, 331, 327; 368/10, 12, 13
See application file for complete search history.

(56) References Cited

U.S. PATENT DOCUMENTS 5,365,494 A * 11/1994 Lynch ..... 368/10
5,369,797 A * 11/1994 Tyree ..... 455/349

* cited by examiner

*Primary Examiner*—Thomas J. Mullen, Jr.
*Assistant Examiner*—Tai T. Nguyen

(57) ABSTRACT

The subject device is an alarm mechanism having a voice message or other sound input wherein the mechanism incorporates a taping mechanism to receive and store voice or other audio sounds to be subsequently or simultaneously projected audibly as a signal to awaken the user of the alarm at a designated time comprising generally a caller mode coupled to a recording controller to activate an audio recorder which is in turn activated by a pre-set timer to project the recorded sound.

1 Claim, 1 Drawing Sheet

ALARM CLOCK WITH VOICE MESSAGE INPUT

KNOW PRIOR ART LIST

Figure 1:
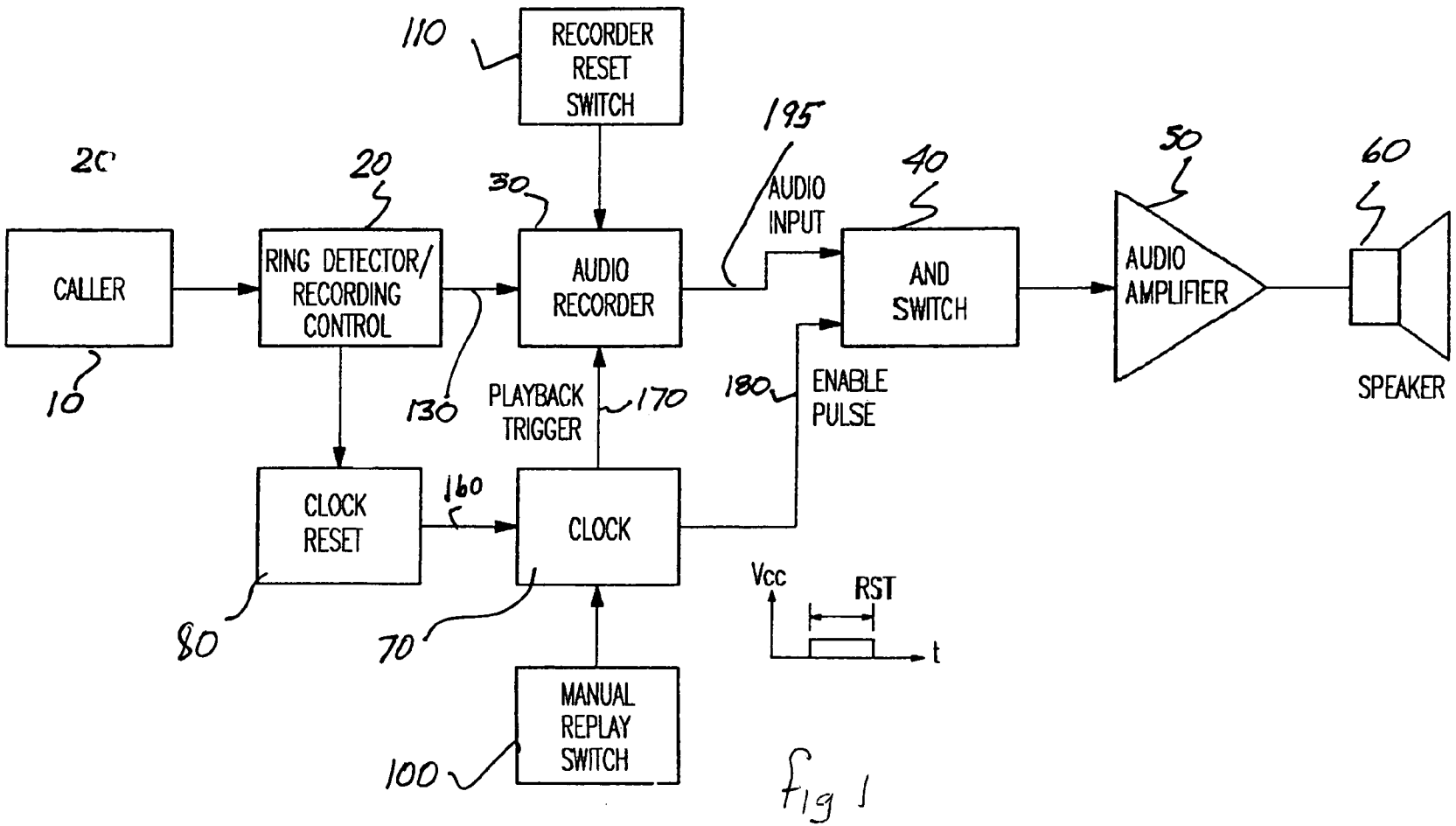

None.

DISCUSSION OF PRIOR ART

Alarm clock systems are adapted to project audible sounds to awaken the user of the alarm. In more general terms the alarm system is used for main purpose to project an audible sound when needed as a wake up alarm, as usually with an alarm buzzer.

One of the problems encountered with the existing alarm systems is that almost all alarm clocks are adapted to project a ringing sound where is generally unpleasant to the individual user and which does not otherwise serve a useful purpose.

In an attempt to alleviate this problem to some degree, certain alarms have been conceived using softer sounds. Radios have been equipped with alarms to project a predetermined radio frequency at a designated time. In light of the above, the following objects are set forth herein.

OBJECTS

In view of the foregoing, it is an object of the subject invention to provide an improved alarm clock device for wall type electrical outlets;

It is also an object of the subject invention to provide an alternate signaling system upon activation of an alarm clock that includes a pre-recorded message or sound;

A further object of the subject invention is to provide an improved sound feature for an alarm system;

A further object of the subject invention is to provide an improved safety device for alarm clock systems;

Still another object of the subject invention is to provide an improved voice message system;

Other objects of the subject invention of the subject invention include the concept of improving the alarm signal output;

Another object of the subject invention is to provide an improved wake-up system. Other and further objects of the subject invention will become manifest upon review of the following description taken in conjunction with the claims.

DRAWINGS

FIG. 1 is a schematic view of the overall system used in conjunction with the subject invention.

DESCRIPTION OF GENERAL EMBODIMENT AND SUMMARY OF INVENTION

The subject device is an alarm clock having a voice message input wherein the clock mechanism incorporates a taping mechanism or other audible transmission system to receive and send voice or other audio sounds to be subsequently or simultaneously projecting audibly as a signal to awaken the user of the alarm at a designated time, the subject invention comprising voice or audible receiving means which then transmits the received to a recorder or other audible storage means. A time-activated mechanism is utilized to activate the recorded audible sound or message through a speaker unit to awaken the user at a pre-determined or other time sequence based in real time parameters.

In general, the subject invention is an alarm clock or mechanism for awakening individuals from their sleep with variant sounds, including voice messages, either previously recorded or transmitted instantly through the alarm system.

In summary, the alarm system incorporating the features of this invention has as a base system, an otherwise conventional alarm clock or other timing device, such alarm clock having an integrated system either within the clock mechanism or associated therewith a sound recorder that is adapted to record voice messages or other sounds into the subject system. This sound recorder is, in turn, interconnected to a sound transmission system that is adapted to project the sounds through a speaker system. This system is structured to project the recorded sound upon activation of the alarm clock alarm system or other timing mechanism at a pre-selected time or at other variant time as desired. When the alarm clock time activates the sound transmission system, the sound recorder will be activated to project the sound to the speaker, either within the alarm clock mechanism or associated therein through a separate system.

The sound projected through the speaker will either supplement or substitute for the usual alarm buzzer. Other variant structural and electronic systems may be used in conjunction with the overall system.

DESCRIPTION OF PREFERRED EMBODIMENT

In describing a preferred embodiment of the subject invention, it is stressed that the following description is of only one embodiment, and that such description should not limit the scope of the invention herein to one such embodiment, as more than one embodiment may fall within the scope of the subject invention as set forth in the claims.

Referring now to FIG. 1 in which a schematic representation of the preferred embodiment of the subject invention is shown, the basic elements of the subject system incorporating the subject system are shown. For purposes of further orientation in describing the preferred embodiment herein, the word "inner" will refer to those parts of the system directly incorporated in the alarm system while the work "external" will be used relative to those elements outside the described alarm system.

Referring now to the drawings, and particularly FIG. 1 in which a preferred embodiment of the subject invention is shown, setting forth schematically the sub elements of the subject invention. Specifically in FIG. 1 is shown schematically a calling mechanism 10 which may be in the form of a telephone integrated directly or indirectly into the overall system. A ring or call detector 20 which has a recording control device generally of an electromechanical structure. The ring or call detector is directly linked to an audio recorder 30 the output of which is fed through an And Gate 40, which in turn leads to an audio amplifier 50 to amplify the sound signal to the speaker 60.

Moreover, the subject system integrally includes a timing mechanism 70, generally in the form of a clock having means to set a signal at a predetermined time for alarm or other purposes. The clock 70 is interconnected to the Audio Recorder 30 with means to activate the audio recorder at the time preset in the timing mechanism 70. A reset device 80 enables the user to reset the alarm set system in the timing mechanism in the timing mechanism. Additionally, the timing mechanism may be equipped with a manually replay switch 100 that the user can replay the sound or voice received through the audio recorder 30.

Moreover, there is a recorder reset switch 110 integrated with the audio recorder which functions to reset the audio recorder for possible replay. The specific interactions of elements are more fully described below.

Attention is again addressed to the schematic display shown in FIG. 1, as seen the caller mechanism 10 is the first element both from the sequential aspect and a real time perspective. A caller will initiate a call to the telephone 10 and upon the detection of a call the detector 20 is automatically activated which in turn relays an electrical signal through electrical lead 130 to the audio recorder 30 in order to turn on the audio recorder. The audio recorder 30 may be used either with an analog system or a digital recording system.

Specifically, in an analog recording system, a presentation of the sound wave is stored directly in the recording medium and on the other hand in digital recording a description of the sound wave is stored in the form of binary or two-state numbers that are recorded as simple on-off signals. The latter method used to encode a sound wave in a numeric form accurately reconstructs in playback through the use of integrated-circuit chips or other means. The digital audio recording is preferably but not necessarily accomplished on compact disc. The compact disc or other means may be reproductions systems monophonic or stereophonic, or quadraphonic sound.

Once the audio recorder records the signal voice or sound message it is stored as discussed above, using one of the recording system discussed above or by way of other recording methods. The sound message is retained in such recorded and stored status until such time as the pre-set time signal in the timing mechanism 70 is set. The timing mechanism in clock 70 is interconnected through lead 1160 which in turn leads to the And Gate 40, with the electrical impulse being withheld from the clock to the And Gate until such time as the pre-set time is reached to activate the play back system. For this purpose the clock timer sends dual signals to the audio recorder and the And Switch 40 through electrical leads 170 and 180 respectively. As stated above, the audio recorder 30 is linked to the And Gate 40 through electrical lead 195 which will transfer the recorded sound signal through the And Gate 40 and ultimately to the audio amplified 50. The output of the And Gate 40 is thus governed and controlled by both the input signals through leads 170 from the clock timer and lead 195 from the audio recorder. Alternately stated there will be no output for the audio recorder signal to the audio recorder through the And Gate 40 until both the clock signal and recorder signal is activated and relays those signals through the And Gaate 40 thence to the amplifier 50 and speaker 60.

The And Gate having received both signals will in turn send the ultimate recorded sound signal to the audio amplifier and speaker. An attendant optional attribute of the subject invention is a manual replay switch interconnected to either the clock or recorder which will activate a replay of the recorded source.

What is claimed is:

1. An alarm system comprising the following elements:

(a) a timer mechanism;

(b) a caller mechanism having an interconnected sound recorder, said recorder having a ring detector to activate said sound recorder wherein said sound recorder for storing received sound;

(c) an audio amplifier interconnected to said sound recorder said audio amplifier being interconnected to a sound speaker;

(d) an And Gate interconnected between said sound recorder and said audio amplifier said And Gate being interconnected by electrical leads to said timer mechanism to receive a signal from said timer mechanism to relay said received sound on said sound recorder to said audio amplifier, and said And Gate having a second electrical lead extending to said sound recorder to receive audio signals from said sound recorder, with said And Gate adapted to activate said amplifier upon the activation of both said interconnected lead from said timer mechanism and activation of said lead from the said sound recorder.

* * * * *